US007146775B2

(12) United States Patent
Burkett

(10) Patent No.: US 7,146,775 B2
(45) Date of Patent: Dec. 12, 2006

(54) WALL SYSTEM

(76) Inventor: Donald L. Burkett, 13617 N. Florida Ave., Tampa, FL (US) 33613

( * ) Notice: Subject to any disclaimer, the term of this patent is extended or adjusted under 35 U.S.C. 154(b) by 398 days.

(21) Appl. No.: 10/751,781

(22) Filed: Jan. 5, 2004

(65) Prior Publication Data

US 2005/0166504 A1 Aug. 4, 2005

(51) Int. Cl.
*E04B 2/00* (2006.01)

(52) U.S. Cl. ..... 52/783.1; 52/796.1; 52/799.14; 52/745.19; 52/747.1; 52/745.05; 52/588.1; 52/293.3; 52/299

(58) Field of Classification Search ..... 52/578–588.1, 52/589.1, 784.12–784.15, 783.1, 796.1, 799.14, 52/745.19, 747.1, 745.05, 745.13, 293.1, 52/293.3, 293.2, 155, 169.9, 299
See application file for complete search history.

(56) References Cited

U.S. PATENT DOCUMENTS 4,189,877 A * 2/1980 Jentoft et al. ..... 52/58
5,311,716 A * 5/1994 Houssin ..... 52/410
5,404,686 A * 4/1995 Esposito ..... 52/588.1
5,509,242 A * 4/1996 Rechsteiner et al. ..... 52/270
5,613,338 A * 3/1997 Esposito ..... 52/588.1
5,758,461 A * 6/1998 McManus ..... 52/293.3
5,838,524 A * 11/1998 Phillips ..... 361/18
5,887,404 A * 3/1999 Kreizinger ..... 52/592.1
6,256,959 B1 * 7/2001 Palmersten ..... 52/588.1
6,412,250 B1 * 7/2002 Davis ..... 52/736.3
6,588,171 B1 * 7/2003 Pryor et al. ..... 52/793.1

* cited by examiner

*Primary Examiner*—Jeanette E. Chapman
(74) *Attorney, Agent, or Firm*—Arthur W. Fisher, III

(57) ABSTRACT

A wall system comprising a plurality of multi-section panels coupled by posts disposed between adjacent multi-section panels wherein each multi-section panel comprises at least two panel sections, each panel section comprising an inner core including a pair of panel surfaces or sides at least the major portion of which is covered by an intermediate member, an upper and lower edge each disposed within a cap and an outer surface covering at least the major portion of the intermediate members and the caps.

7 Claims, 5 Drawing Sheets

WALL SYSTEM

BACKGROUND OF THE INVENTION

1. Field of the Invention

A wall system comprising a plurality of multi-section panels.

2. Description of the Prior Art

Walls and fences are manufactured from different types of materials. Some of the more common types of materials that walls and fences are constructed of include wood, brick, masonry block or wire.

Wood walls or fences have the disadvantage in that they can be more easily damaged or chipped. The surface of a wood wall or fence begins to weather down after a period of time, and pieces of the wall or fence have to be replaced on a periodic basis. A wood wall or fence is not as sturdy as the other types of walls or fences, and it may not stand up against the wind as well as the others.

A wire wall or fence is also not as sturdy or solid as the other types of fences. Typically, a wire wall or fence encompasses a certain area, but the surface of the wall or fence is usually not covered. A wire wall or fence also has the disadvantages of a person being able to cut through it, or a person bending the surfaces or sides of the wire wall or fence.

Brick or masonry block type walls and fences have the advantage of being strong and sturdy. Such walls and fences hold up very well against the wind, and they are not easily broken. They have the further advantage in that stucco can be applied to the surface of the wall or fence to create a more appealing aesthetics especially for a wall or fence that can be matched to the exterior of a house. These types of walls or fences have been required by certain municipal housing or zoning laws.

Brick or block masonry type walls or fences, however, have several disadvantages. They are more expensive because they require significant time, labor, and material to construct. Another problem with these types of walls or fences is that the top row of bricks or blocks can be easily knocked off. These brick and masonry block type walls or fences have the further problem of weight settling which in effect causes ladder cracks in the surfaces and sides of the wall or fence.

U.S. Pat. No. 6,112,489 relates to a monocoque concrete structure including a core structure of foam panels. A layer of concrete is applied to opposite sides of the core structure to form a double monocoque concrete structure having a load bearing concrete shell on each of the opposite sides of the core structure.

U.S. Pat. No. 5,404,685 describes an outside polystyrene plastic wall or fence constructed by anchoring each of at least two styrofoam H-columns to a concrete base in the ground supporting a steel reinforcing bar which extends up into a hollow of the column by filling the hollows with concrete.

U.S. Pat. No. 5,335,472 relates to a reinforced concrete building having vertical walls formed of prefabricated modules that may be assembled off site and then transported to the construction site for installation and application of concrete. The prefabricated modules are supported between lower and upper support members and spaced from each other a sufficient distance for a concrete column therebetween. A backing member is secured between adjacent modules and vertical reinforcing rods are provided adjacent backing member in the space between the modules for the concrete columns. Concrete is applied pneumatically against the backing member to fill the space between the modules to form the concrete column.

U.S. Pat. No. 5,033,248 describes a reinforced concrete building constructed from a plurality of prefabricated modules which may be assembled off site and then transported or shipped to the building construction site for installation and application of concrete. Each prefabricated module includes a rectangular frame having channel-shaped frame members which form the ends and sides of the frame. An insulation layer is mounted within the frame in spaced relation to one side frame member. A channel-shaped concrete column form is secured between the insulation layer and the adjacent side frame member to close the frame. A wire mesh layer is secured to the outer surface of the frame with an overhanging side portion. The prefabricated module when shipped to a construction site receives reinforcing bars and concrete is pneumatically applied for forming a reinforced concrete wall. A drywall panel is then mounted on modules for the interior of the building.

U.S. Pat. No. 5,515,659 teaches a building system for wall construction including a prefabricated panel having two layers of foamed insulating sheets sandwiched around a layer of concrete or other cementitious material. Channels are cut into an interior face of one of the panels. The channels receive cement which provides a reinforcing structure when hardened. Steel vertical channel studs encase the sandwiched layers on two sides of the panel. The vertical channel studs have a vertical surface which is fastened to a similar, opposing vertical channel stud of an adjoining panel to effectively create a vertical I-beam support when the panels are assembled together. The panels of the invention can be readily transported to a worksite, assembled, and finished on-site with a stress-skin to yield a wall which is extremely rigid, insulative, and resistant to forces such as fire, water, termites, and impact.

U.S. Pat. No. 4,489,530 shows a method of making a sandwich type insulation wall having internal framework formed by channel bars and transverse members bridging two adjacent channel bars. A plurality of channel bars having lateral wings are erected to form the main skeleton with insulating material inserted into the channels of the bars to secure them in place. Transverse members are positioned to cover the wall spaced from the insulating board by the wings and transverse members. Both sides of the structure are grouted with a grouting cement or vermiculite.

U.S. Pat. No. 6,418,686 describes a structural building system including a structural-load-bearing building component, such as a building panel, having front and back sections, an insulating core, integral symmetrical joinery, a thermal break, and at least one shear resistance connector. The panel is asymmetrical about one axis, and is designed to be directionally positioned with respect to the maximum anticipated force. A shear resistance connector array may be positioned between the front and back sections or may be integral to the front or back section. A face sheet may span one or more than one building panel, and provides structural support to the building system.

Additional examples of the prior art are found in U.S. Pat. No. 4,297,820 and Publication 2002/0189182.

SUMMARY OF THE INVENTION

The present invention relates to a wall system comprising a plurality of multi-section panels coupled by posts.

Each multi-section panel comprises two or more panel sections coupled together. Each panel section comprises an inner core and an intermediate member disposed on each side of the inner member.

The upper and lower edges each multi-section panel are disposed within a corresponding cap.

The intermediate members on opposite sides of each inner member, the upper and lower edge caps and the post(s) are coated with an outer layer or skin of material.

When assembled and constructed, the intermediate members add strength and rigidity to protect the corresponding inner cores; while, the upper and lower edges of the panel sections of each multi-section panels are protected by the corresponding caps. In turn, the exterior surfaces of the intermediate members and the caps on the upper and lower edges of the panel sections are coated or surfaced with the outer layer or skin to finish and protect the wall system.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
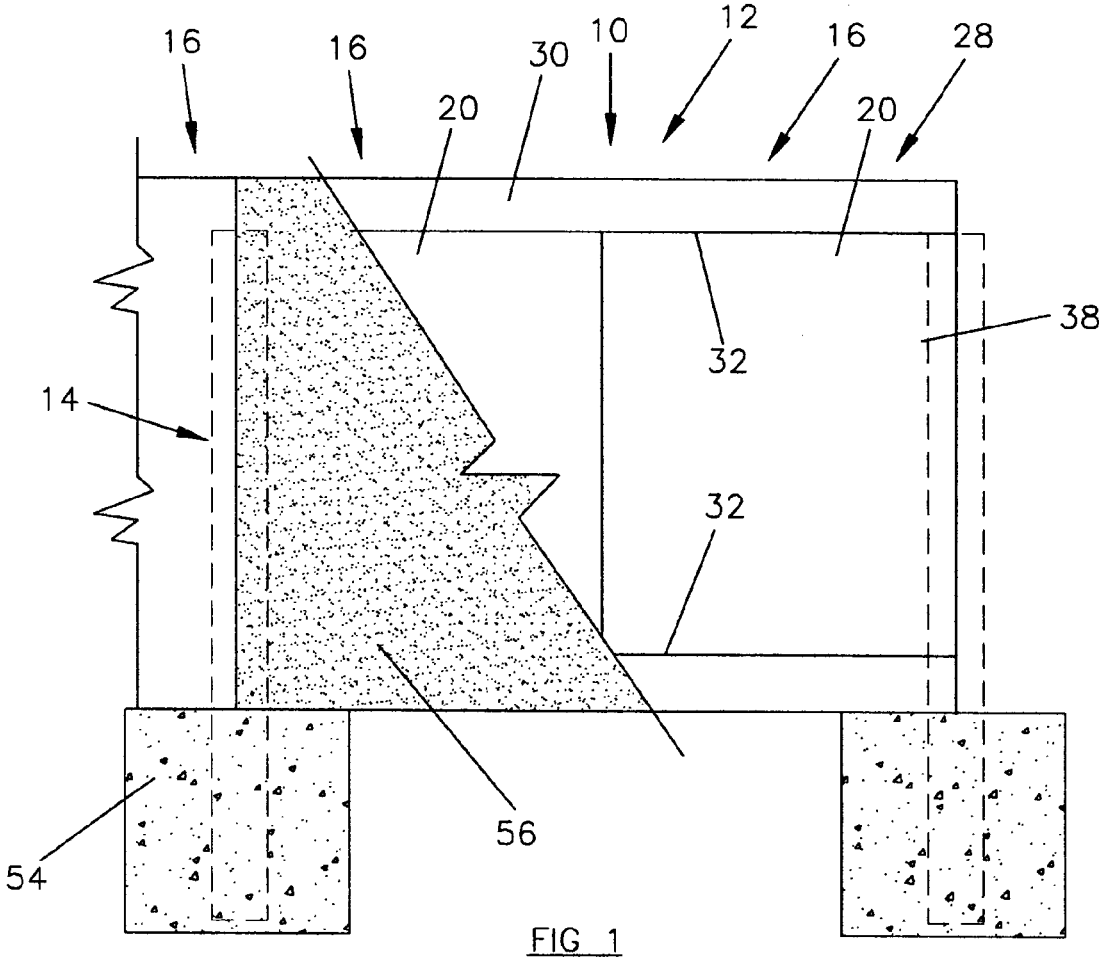
FIG. 1 is a partial cross-sectional front view of the wall system of the present invention.
Figure 2:
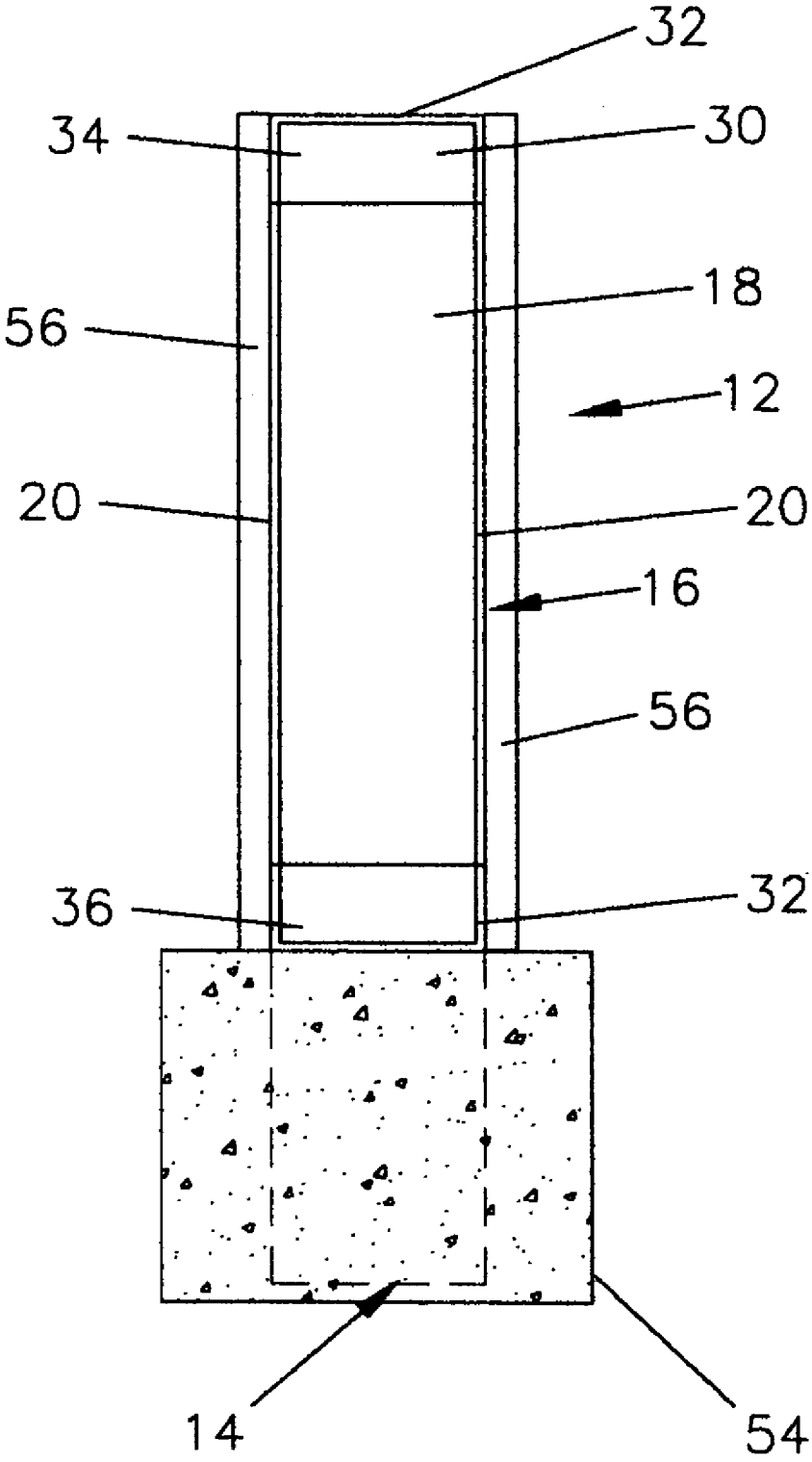
FIG. 2 is a cross-sectional end view of the wall system of the present invention.
Figure 3:
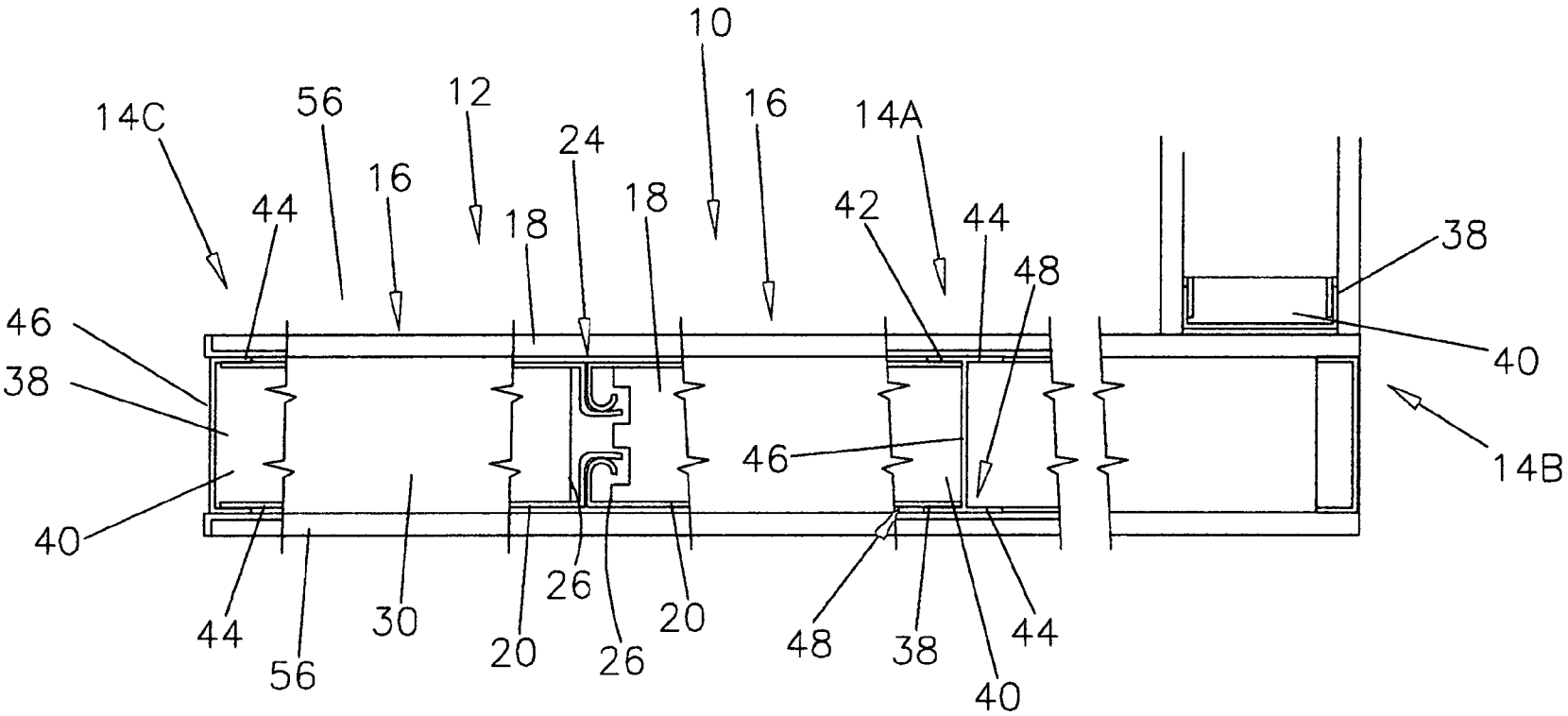
FIG. 3 is a partial cross-sectional top view of the wall system of the present invention.

As shown in FIGS. 1 through 3, the present invention relates to a wall system generally indicated as 10 comprising a plurality of multi-section panels each generally indicated as 12 held in a substantially vertical position by a plurality of substantially vertical posts each generally indicated as 14.

Each multi-section panel 12 comprises at least two panel sections each generally indicated as 16 including an inner core 18 and an intermediate member 20 disposed on each side 22 of the corresponding inner core 18. The corresponding panel sections 16 of each inner core 18 can be coupled or interlocked together by an interlocking element generally indicated as 24 or similar attachment or fastening device on the adjacent interior ends 26 of the adjacent panel sections 16.

An upper and lower edge cap 30 and 32 respectively at least partially cover the upper and lower edge portion 34 and 36 respectively of the multi-section panels 12. Alternatively, a peripheral frame generally indicated as 28 is formed about the periphery of each multi-section panel 12. The peripheral frame 28 comprises a substantially C-shaped upper and lower edge cap indicated as 30 and 32 respectively disposed to at least partially cover the upper and lower edge portions 34 and 36 respectively of the multi-section panels 12 and a pair of substantially C-shaped end caps each indicated as 38 disposed to at least partially cover opposite end portions 40 the multi-section panel 12.

As best shown in FIG. 3 the post 14 may comprise one or more interior posts 14A, one or more corner posts 14B and one or more end posts 14C. The interior posts 14A comprise a substantially H-shaped member 42 including a pair of retaining plates or elements each indicated as 44 held in substantially parallel relationship relative to each other by a central web or cross-member 46 to cooperatively form a pair of back-to-back panel receiving channels each indicated as 48 therebetween to receive one outer end portion 40 and corresponding end cap 38 of adjacent multi-section panels 12 therein. The corner posts 14B comprises a substantially L-shaped member 42 including a pair of retaining plates or elements each indicated as 44 held in spaced relationship relative to each other by a central web or cross-member 46 to cooperatively form a pair of adjacent panel receiving channels 48 therebetween to receive one outer end portion 40 and corresponding end cap 38 of adjacent multi-section panels 12 therein. Of course, the centerline of the adjacent panel receiving channels 48 may form an angle greater or less than 90 degrees so that adjacent multi-section panels 12 may form an angle greater than or less than 90 degrees. The end posts 14C comprise a substantially C-shaped member 52 including a panel receiving channel 48 to receive an outer end portion 40 and corresponding end cap 38 therein.

Of course, any post 14 having a panel receiving channel 48 to receive an outer portion 40 of a multi-section panel 12 can be used. Alternatively, any post 14 to which an end cap 38 can be coupled with a bracket, fastening or such, can be used in place of a post 14 with a panel receiving channel 48.

The inner core 18 may comprise cellular foam, structural insulation panel or similar material; while, the intermediate members 20, the upper and lower edge caps 30 and 32, and end edge caps 38 and the posts 14 may comprise a metal or other rigid material to strengthen the panel sections 16 and the multi-section panels 12.

When the multi-sectional panels 12 are erected or assembled on the posts 14 securely placed in the ground 54, the outer surfaces of the multi-section panels 12, the upper and lower edge caps 30 and 32, and the posts 14 are covered or coated with material such as paint to form a decorative protective outer skin or layer or surface 56 to protect the wall system 10 from the environmental elements. Any portion of the end edge caps 38 exposed beyond the posts 14 will also be covered or coated.

Figure 4:
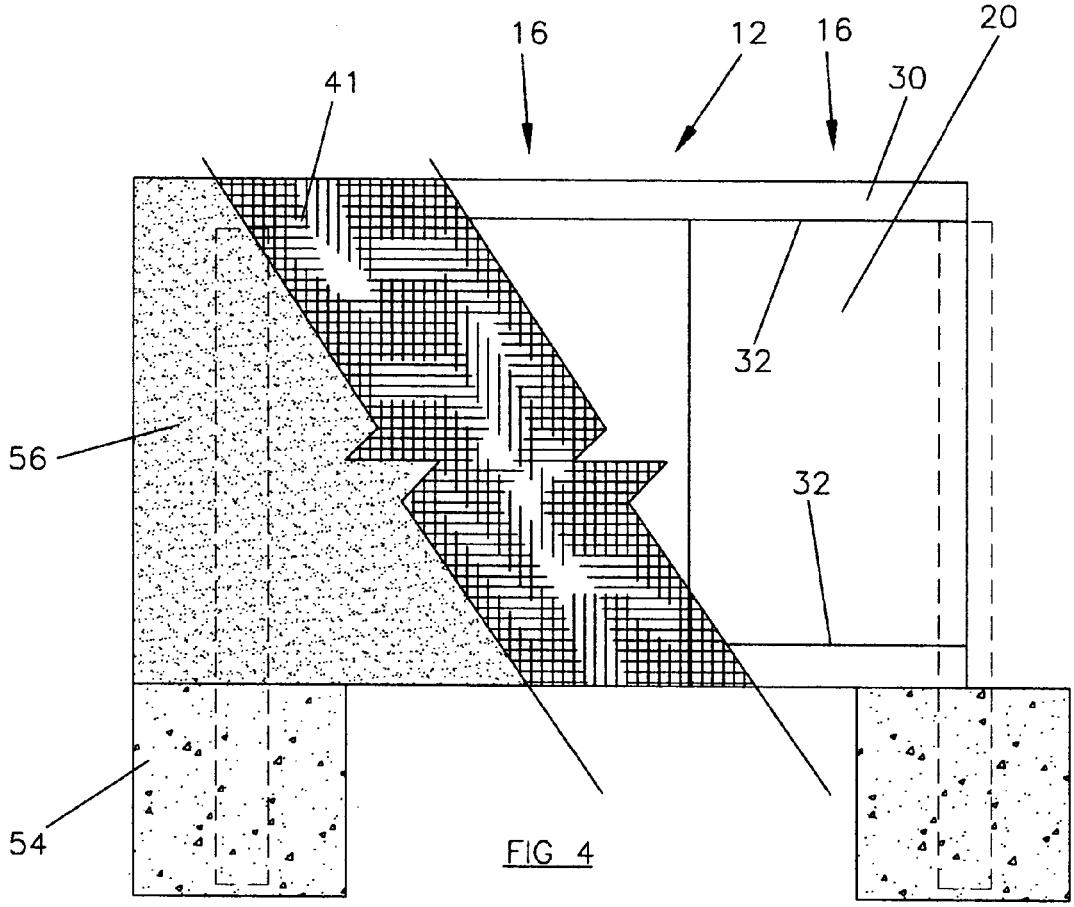
FIG. 4 is a partial cross-sectional front view of an alternate embodiment of the wall system of the present invention.

FIG. 4 shows an alternate embodiment of the wall system 10 with similar components being similarly designated. Specifically, each multi-section panel 12 comprises at least two panel sections each generally indicated as 16 including an inner core 18 and an intermediate member 20 disposed on each side 22 of the corresponding inner core 18. The corresponding panel sections 16 of each inner core 18 can be coupled or interlocked together by an interlocking element 24 or similar attachment or fastening device on the adjacent interior ends 26 of the adjacent panel sections 16 similar to the structure of FIGS. 1 through 3. A peripheral frame generally indicated as 28 is formed about the periphery of each multi-section panel 12. The peripheral frame 28 comprises a substantially C-shaped upper and lower edge cap indicated as 30 and 32 respectively disposed to at least partially cover the upper and lower edge portions 34 and 36 respectively of the multi-section panels 12 and a pair of substantially C-shaped end caps each indicated as 38 disposed to at least partially cover opposite end portions 40 the multi-section panel 12 similar to the wall system 10 shown in FIGS. 1 through 3.

The inner core 18, the intermediate members 20 and the peripheral frame 28 are similar to those shown in FIGS. 1 through 3.

When the multi-sectional panels 12 are erected or assembled on the posts 14 securely placed in the ground 54, the outer surfaces of the multi-section panels 12, upper and lower edge caps 30 and 32, and posts 14 are covered or coated with material such as paint, stucco or cement to form a decorative protective outer skin or layer or surface 56 to protect the wall system 10 from the environmental elements. Any portion of the end edge caps 38 exposed beyond the posts 14 will also be covered or coated.

A mesh 41 is attached or otherwise operatively cemented on the outer surface of the intermediate members 20 on opposite sides of each multi-section panel 12 to receive and support the outer skin or layer 56 thereon.

Figure 5:
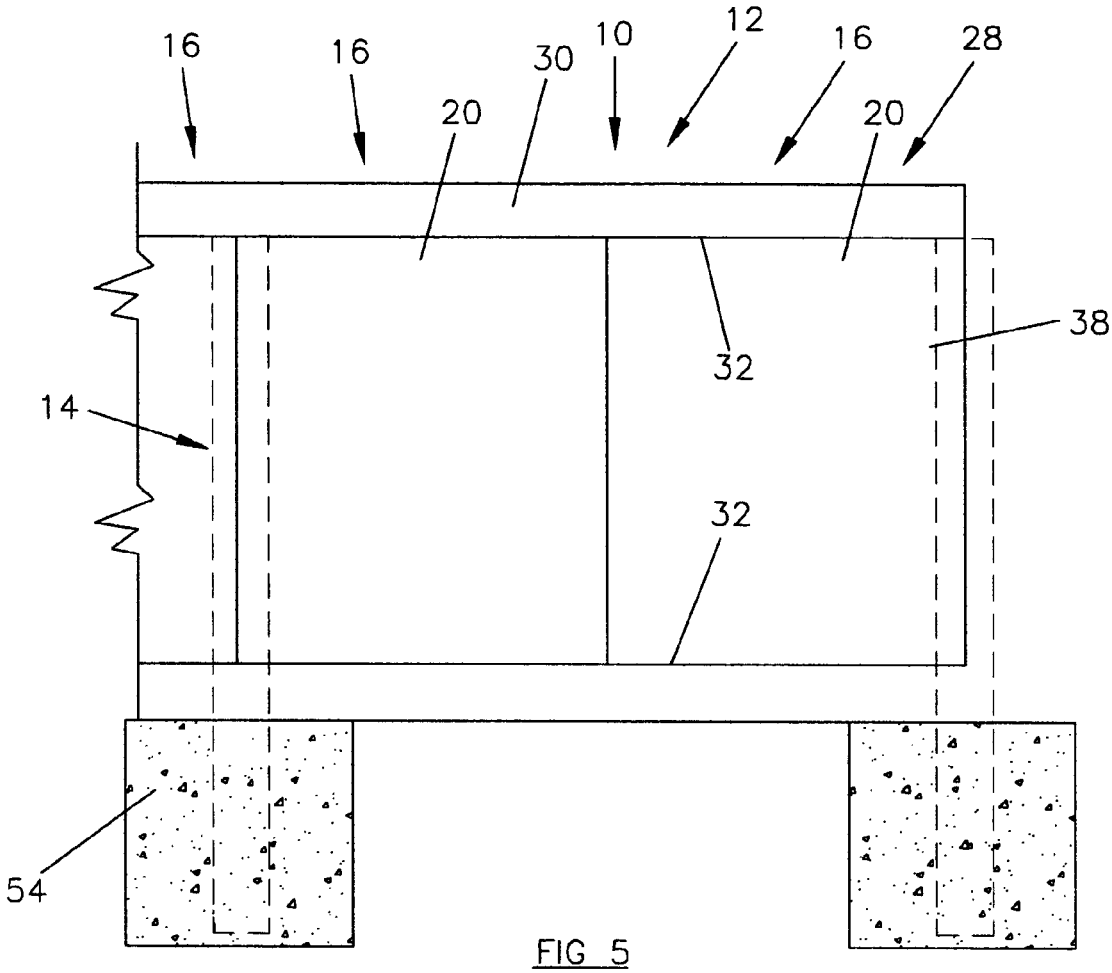
FIG. 5 is a front view of another alternate embodiment of the wall system of the present invention.

FIG. 5 shows another alternate embodiment of the wall system 10 with similar components being similarly designated. Specifically, each multi-section panel 12 comprises at least two panel sections each generally indicated as 16 including an inner core 18 and an outer member 20 disposed on each side 22 of the corresponding inner core 18. The corresponding panel sections 16 of each inner core 18 can be coupled or interlocked together by an interlocking element 24 or similar attachment or fastening device on the adjacent interior ends 26 of the adjacent panel sections 16 similar to the structure of FIGS. 1 through 3. A peripheral frame is formed about the periphery of each multi-section panel 12. The peripheral frame 28 comprises a substantially C-shaped upper and lower edge cap indicated as 30 and 32 respectively disposed to at least partially cover the upper and lower edge portions respectively of the multi-section panels 12 similar to the wall system 10 shown in FIGS. 1 through 3.

The inner core 18, the outer members 20 and the peripheral frame 28 are similar to those shown in FIGS. 1 through 3. The multi-sectional panels 12 are erected or assembled on the posts 14 securely placed in the ground 54.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A wall system comprising a plurality of multi-section panels coupled by posts disposed between adjacent multi-section panels wherein each multi-section panel comprises at least two panel sections, each said panel section comprising an inner core including a panel surface on each side thereof at least the major portion of which is covered by an intermediate member, a peripheral frame including an end edge cap disposed on each end portion of each said multi-section panel and an upper and lower edge cap disposed on an upper and lower edge of each said multi-section panel respectively and an outer layer covering at least the major portion of said intermediate members; corresponding panel sections of each inner core coupled together by an interlocking element disposed on the adjacent interior ends of adjacent panel sections; said posts comprises at least one interior post and at least one end post; said interior post comprises a substantially H-shaped member forming a pair of panel receiving channels to receive adjacent end portions of adjacent multi-section panels and at least portions of said end edge caps of said adjacent multi-section panel and said end post comprising a substantially C-shaped member to receive an end portion of said multi-section panel at least a portion of said end edge cap of said end portion of said multi-section panel; and said inner core comprising cellular foam and said intermediate members, upper and lower edge caps and said end edge caps comprise a rigid material to strengthen said multi-section panels.

2. The wall system of claim 1 wherein said outer layer comprises a mesh substrate attached to each said intermediate member to receive and support a protective coating thereon.

3. A wall system comprising a plurality of multi-section panels coupled by posts disposed between adjacent multi-section panels wherein each multi-section panel comprises at least two panel sections, each said panel section comprising an inner core including a panel surface on each side thereof at least the major portion of which is covered by an intermediate member, a peripheral frame including an end edge cap disposed on each end portion of each said multi-section panel and an upper and lower edge cap disposed on an upper and lower edge of each said multi-section panel respectively and an outer layer covering at least the major portion of said intermediate members; said posts comprises at least one interior post and at least one end post; said interior post comprises a substantially H-shaped member forming a pair of panel receiving channels to receive adjacent end portions of adjacent multi-section panels and at least portions of said end edge caps of said adjacent multi-section panel and said end post comprising a substantially C-shaped member to receive an end portion of said multi-section panel at least a portion of said end edge cap of said end portion of said multi-section panel; and said inner core comprising cellular foam and said intermediate members, upper and lower edge caps and said end edge caps comprise a rigid material to strengthen said multi-section panels.

4. The wall system of claim 3 wherein said outer layer comprises a mesh substrate attached to each said intermediate member to receive and support a protective coating thereon.

5. A wall system comprising a plurality of multi-section panels coupled by posts disposed between adjacent multi-section panels wherein each multi-section panel comprises at least two panel sections, each said panel section comprising an inner core of foam material including a panel surface on each side thereof at least the major portion of which is covered by an intermediate member, an upper and lower edge each disposed within a cap and an outer layer covering at least the major portion of said intermediate members including a mesh substructure secured to each said intermediate member to support a protective coating thereon and said caps; corresponding panel sections of each inner core coupled together by an interlocking element disposed on the adjacent interior ends of adjacent panel sections; said posts comprises at least one interior post and at least one end post; said interior post comprises a substantially H-shaped member forming a pair of panel receiving channels to receive adjacent end portions of adjacent multi-section panels and said end post comprising a substantially C-shaped member to receive an end portion of said multi-section panel.

6. A wall system comprising a plurality of multi-section panels coupled by posts disposed between adjacent multi-section panels wherein each multi-section panel comprises at least two panel sections, each said panel section comprising an inner core of foam material including a panel surface on each side thereof at least the major portion of which is covered by an intermediate member of rigid matter, an upper and lower edge each disposed within a cap and an outer layer covering at least the major portion of the intermediate members and said caps; corresponding panel sections of each inner core coupled together by an interlocking element disposed on the adjacent interior ends of adjacent panel sections; said posts comprises at least one interior post and at least one end post; said interior post comprises a substantially H-shaped member forming a pair of panel receiving channels to receive adjacent end portions of adjacent multi-section panels and said end post comprising a substantially C-shaped member to receive an end portion of said multi-section panel.

7. The wall system of claim 6 wherein said outer layer comprises a mesh substrate attached to each said intermediate member to receive and support a protective coating thereon.

* * * * *